US010003904B2

(12) United States Patent
Oh et al.

(10) Patent No.: US 10,003,904 B2
(45) Date of Patent: Jun. 19, 2018

(54) METHOD AND DEVICE FOR PROCESSING BINAURAL AUDIO SIGNAL GENERATING ADDITIONAL STIMULATION

(71) Applicant: GAUDI AUDIO LAB, INC., Seoul (KR)

(72) Inventors: Hyunoh Oh, Seongnam-si (KR); Yonghyun Baek, Seoul (KR)

(73) Assignee: GAUDI AUDIO LAB, INC., Seoul (KR)

( * ) Notice: Subject to any disclaimer, the term of this patent is extended or adjusted under 35 U.S.C. 154(b) by 4 days.

(21) Appl. No.: 15/629,688

(22) Filed: Jun. 21, 2017

(65) Prior Publication Data

US 2017/0289729 A1 Oct. 5, 2017

Related U.S. Application Data

(63) Continuation of application No. PCT/KR2015/014217, filed on Dec. 23, 2015.

(30) Foreign Application Priority Data

Dec. 30, 2014 (KR) ..... 10-2014-0193545
Aug. 12, 2015 (KR) ..... 10-2015-0114080

(51) Int. Cl.
*H04R 5/00* (2006.01)
*H04S 7/00* (2006.01)
*H04S 5/00* (2006.01)

(52) U.S. Cl.
CPC ..... *H04S 7/304* (2013.01); *H04S 5/00* (2013.01); *H04S 2400/01* (2013.01); *H04S 2400/11* (2013.01); *H04S 2420/01* (2013.01)

(58) Field of Classification Search
USPC ..... 381/1, 17, 18, 19, 22, 23, 27, 74, 309, 381/310, 374
See application file for complete search history.

(56) References Cited

U.S. PATENT DOCUMENTS

2014/0153765 A1* 6/2014 Gan ..... H04R 1/1075 381/374

FOREIGN PATENT DOCUMENTS

| | | | | |
|---|---|---|---|---|
| JP | 2009-049844 A | | 3/2009 | |
| JP | 2009-522610 A | | 6/2009 | |
| KR | 10-2008-0069400 A | | 7/2008 | |
| KR | 10-2011-0074366 A | | 6/2011 | |
| WO | WO 2014111765 | * | 7/2014 | ..... H04S 7/00 |

OTHER PUBLICATIONS

International Search Report and Written Opinion of the International Searching Authority dated May 13, 2016 for Application No. PCT/KR2015/014217.

* cited by examiner

*Primary Examiner* — Yosef K Laekemariam
(74) *Attorney, Agent, or Firm* — Park, Kim & Suh, LLC

(57) ABSTRACT

Disclosed is a binaural audio signal processing device. The binaural audio signal processing device includes a binaural renderer and an extra exciter. The binaural renderer receives an audio signal, and outputs a binaural-rendered audio signal by performing binaural rendering on the received audio signal. The extra exciter generates a stimulation to a body of a user, wherein the stimulation corresponds to the binaural-rendered audio signal.

14 Claims, 5 Drawing Sheets

METHOD AND DEVICE FOR PROCESSING BINAURAL AUDIO SIGNAL GENERATING ADDITIONAL STIMULATION

CROSS-REFERENCE TO RELATED APPLICATIONS

This application claims the benefit under 35 U.S.C. § 120 and § 365(c) to a prior PCT International Application No. PCT/KR2015/014217, filed on Dec. 23, 2015, which claims the benefit of Korean Patent Application No. 10-2014-0193545, filed on Dec. 30, 2014, and Korean Patent Application No. 10-2015-0114080 filed on Aug. 12, 2015, the entire contents of which are incorporated herein by reference.

TECHNICAL FIELD

The present invention relates to an audio signal processing method and device. More specifically, the present invention relates to an audio signal processing method and device for synthesizing an object signal and a channel signal and effectively binaural-rendering a synthesized signal.

BACKGROUND ART 3D audio commonly refers to a series of signal processing, transmission, encoding, and playback techniques for providing a sound which gives a sense of presence in a three-dimensional space by providing an additional axis corresponding to a height direction to a sound scene on a horizontal plane (2D) provided by conventional surround audio. In particular, 3D audio requires a rendering technique for forming a sound image at a virtual position where a speaker does not exist even if a larger number of speakers or a smaller number of speakers than that for a conventional technique are used.

3D audio is expected to become an audio solution to an ultra high definition TV (UHDTV), and is expected to be applied to various fields of theater sound, personal 3D TV, tablet, wireless communication terminal, and cloud game in addition to sound in a vehicle evolving into a high-quality infotainment space.

Meanwhile, a sound source provided to the 3D audio may include a channel-based signal and an object-based signal. Furthermore, the sound source may be a mixture type of the channel-based signal and the object-based signal, and, through this configuration, a new type of listening experience may be provided to a user.

Binaural rendering is performed to model such a 3D audio into signals to be delivered to both ears of a human being. A user may experience a sense of three-dimensionality from a binaural-rendered 2-channel audio output signal through a headphone or an earphone. A specific principle of the binaural rendering is described as follows. A human being listens to a sound through two ears, and recognizes the location and the direction of a sound source from the sound. Therefore, if a 3D audio can be modeled into audio signals to be delivered to two ears of a human being, the three-dimensionality of the 3D audio can be reproduced through a 2-channel audio output without a large number of speakers.

However, a human being may recognize the direction and the level of a sound not only through the sound but also through a vibration generated due to the sound. Therefore, such a vibration also significantly affects human being's recognition of three-dimensionality of a sound. Therefore, if a binaural rendering audio signal processing device gives an additional stimulation to a user together with binaural rendering, the binaural rendering audio signal processing device may improve three-dimensionality perceived by a user through binaural rendering.

DISCLOSURE

Technical Problem

An object of an embodiment of the present invention is to provide a binaural audio signal processing device and method for playing multi-channel or multi-object signals in stereo.

In particular, an object of an embodiment of the present invention is to provide a binaural audio signal processing device and method for improving three-dimensionality by providing an additional stimulation.

Technical Solution

An audio signal processing device according to an embodiment of the present invention includes: a binaural renderer configured to receive an audio signal and output a binaural-rendered audio signal by performing binaural rendering based on the received audio signal; and an extra exciter configured to generate a stimulation to a body of a user, wherein the stimulation corresponds to the binaural-rendered audio signal.

Here, the extra exciter may deliver the stimulation to a head of the user.

Furthermore, the extra exciter may generate the stimulation based on a position of a sound source simulated by the binaural-rendered audio signal.

The extra exciter may include a plurality of excitation transducers, may select at least one of the plurality of excitation transducers based on the position of the sound source simulated by the binaural-rendered audio signal, and may generate the stimulation through the selected at least one excitation transducer.

Here, the extra exciter may generate the stimulation based on a distance between the user and the position of the sound source simulated by the binaural-rendered audio signal.

Furthermore, the extra exciter may generate the stimulation in at least one of a case where an interaural level difference of the binaural-rendered audio signal is smaller than a first reference value and a case where an interaural time difference of the binaural-rendered audio signal is smaller than a second reference value.

Furthermore, the extra exciter may generate an additional stimulation based on a frequency value of a notch included in a head related transfer function (HRTF) applied to the binaural rendering.

Here, the extra exciter may determine whether to generate the additional stimulation based on the frequency value of the notch included in the HRTF.

Furthermore, the extra exciter may determine a position at which the additional stimulation is to be generated, based on the frequency value of the notch included in the HRTF.

The received audio signal may include a first audio signal output through the extra exciter and a second audio signal output through the binaural renderer, wherein the second audio signal may be generated based on an audio signal obtained by subtracting the first audio signal from the received audio signal.

Here, the binaural renderer may separate the received audio signal into the first audio signal and the second audio signal according to a frequency characteristic of the received audio signal.

Furthermore, the binaural renderer may apply, to the received audio signal, a head related transfer function (HRTF) for modeling a remaining region excepting a frequency band corresponding to the first audio signal.

The stimulation may be at least one of a non-invasive brain/neural excitation, a vibration, and a bone conduction signal.

The stimulation may be synchronized with a time of the binaural-rendered audio signal.

The extra exciter may generate the stimulation based on a magnitude of the binaural-rendered audio signal.

The extra exciter may generate the stimulation based on a frequency of the binaural-rendered audio signal.

The extra exciter may adjust a magnitude of the stimulation based on a threshold value.

Here, the threshold value may be determined based on a user input.

The extra exciter may generate the stimulation according to a scaling value applied to a step of discriminating a magnitude of the stimulation.

Here, the scaling value is determined based on an external environment of the user.

The scaling value may be determined based on a noise of the external environment of the user.

A method for operating an audio signal processing device according to an embodiment of the present invention includes the steps of: receiving an audio signal; outputting a binaural-rendered audio signal by performing binaural rendering based on the received audio signal; and generating a stimulation to a body of a user, wherein the stimulation corresponds to the binaural-rendered audio signal.

Advantageous Effects

An embodiment of the present invention provides a binaural audio signal processing device and method for playing multi-channel or multi-object signals in stereo.

In particular, an embodiment of the present invention may provide a binaural audio signal processing device and method for improving three-dimensionality by providing an additional stimulation.

MODE FOR CARRYING OUT THE INVENTION

Figure 1:
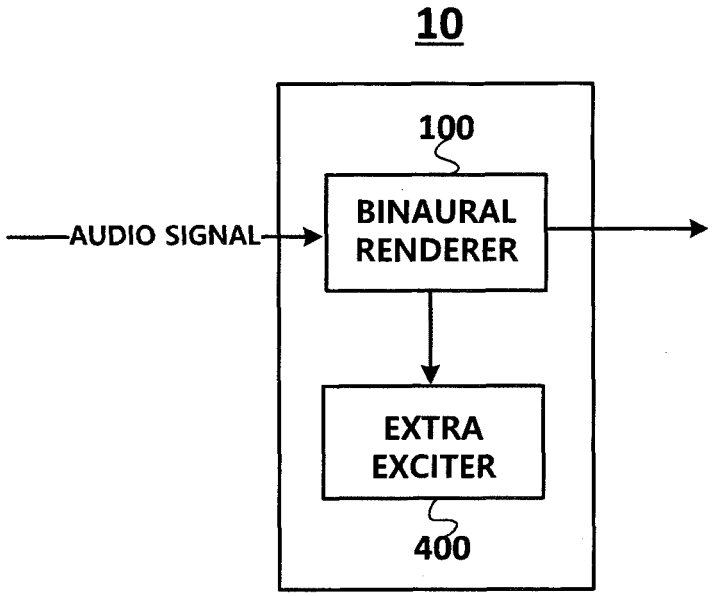
FIG. 1 is a block diagram illustrating a binaural audio signal processing device according to an embodiment of the present invention.

Hereinafter, embodiments of the present invention will be described in detail with reference to the accompanying drawings so that the embodiments of the present invention can be easily carried out by those skilled in the art. However, the present invention may be implemented in various different forms and is not limited to the embodiments described herein. Some parts of the embodiments, which are not related to the description, are not illustrated in the drawings in order to clearly describe the embodiments of the present invention. Like reference numerals refer to like elements throughout the description.

When it is mentioned that a certain part "includes" certain elements, the part may further include other elements, unless otherwise specified.

The present application claims priority of Korean Patent Application Nos. 10-2014-0193545 and 10-2015-0114080, the embodiments and descriptions of which are deemed to be incorporated herein.

FIG. 1 is a block diagram illustrating a binaural audio signal processing device according to an embodiment of the present invention.

A binaural audio signal processing device 10 according to an embodiment of the present invention includes a binaural renderer 100 and an extra exciter 400.

The binaural renderer 100 receives an audio signal. The binaural renderer 100 performs binaural rendering on the received audio signal to output a binaural-rendered audio signal. Here, the audio signal received by the binaural renderer 100 may be a mono audio signal or an audio signal including one object. In another embodiment, the audio signal received by the binaural renderer 100 may be an audio signal including a plurality of objects or a plurality of channel signals.

The extra exciter 400 generates a stimulation to a body of a user. Here, the stimulation corresponds to the binaural-rendered audio signal. In detail, the extra exciter 400 may generate the stimulation synchronized with the binaural-rendered audio signal to provide the stimulation to the body of the user. Here, the extra exciter 400 may receive, from the binaural renderer 100, information required for generating the stimulation to the body of the user. In detail, the information required for generating the stimulation to the body of the user may be at least one of position information indicating a position of a sound source simulated by the binaural-rendered audio signal, a magnitude of the binaural-rendered audio signal, a frequency of the binaural-rendered audio signal, and synchronization information of the binaural-rendered audio signal. Here, in the case where the audio signal is a channel signal, the position information may be information indicating the position of a sound source formed on a three-dimensional sound scene formed by the channel signal. In the case where the audio signal is an object signal, the position information may be information indicating a position corresponding to the position on a three-dimensional sound scene identified by metadata on an object.

Meanwhile, when binaural rendering is completed, the position of the sound source simulated by the binaural-rendered audio signal cannot be directly detected. Therefore, the extra exciter 400 may inversely estimate at least one of an interaural level difference (ILD) and an interaural time difference (ITD) using a left-side signal and a right-side signal of the binaural-rendered audio signal, and may obtain the position information based on at least one of the ILD and the ITD inversely estimated. Furthermore, the extra exciter 400 may obtain the position information based on a frequency at which a notch that the left-side signal and the right-side signal of the binaural-rendered audio signal includes exists and a size of the notch.

For this operation, the extra exciter 400 may receive the binaural-rendered audio signal from the binaural renderer 100. In another specific embodiment, the extra exciter 400 may intactly receive the audio signal received by the binaural renderer 100.

The stimulation to the body of the user, generated by the extra exciter 400, may include at least one of a non-invasive brain/neural excitation, a vibration, and a bone conduction signal. In detail, the non-invasive brain/neural excitation may be any one of a transcranial direct current stimulation (TDCS), a transcranial alternating current stimulation (TACS), a transcranial magnetic stimulation (TMS), and a transcranial electrical stimulation (TES).

Furthermore, the extra exciter 400 may deliver, to a head of the user, the above-described stimulation. This is because a human being can more precisely recognize the position of a sound source when sound waves are delivered to the eardrums through the head.

Furthermore, the extra exciter 400 may include an excitation transducer for generating the stimulation to the body of the user. In another specific embodiment, the extra exciter 400 may generate a control signal for controlling the excitation transducer located outside the extra exciter. In this case, the excitation transducer generates the stimulation to the body of the user in response to the control signal.

By virtue of this operation of the extra exciter 400, the user may recognize the position of a sound source which is difficult for the user to recognize through the binaural-rendered audio signal alone. Relevant detailed descriptions will be provided with reference to FIG. 2A and FIG. 2B.

Figure 2A:
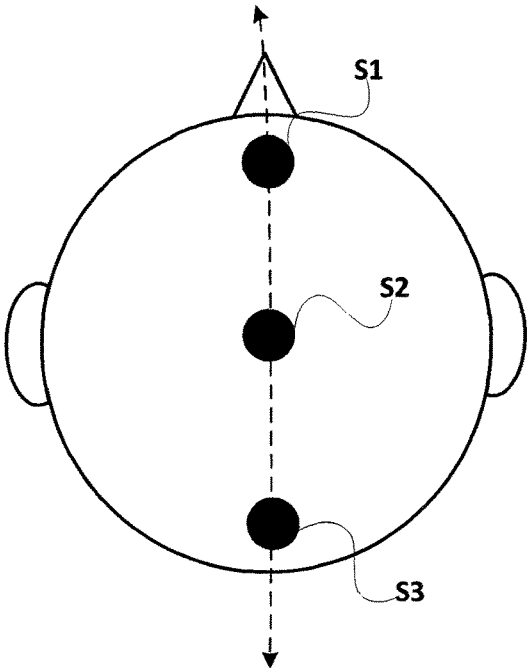
FIG. 2A and FIG. 2B illustrate an example of the position of a sound source which is difficult for a user to recognize through a binaural-rendered audio signal alone.
Figure 2B:
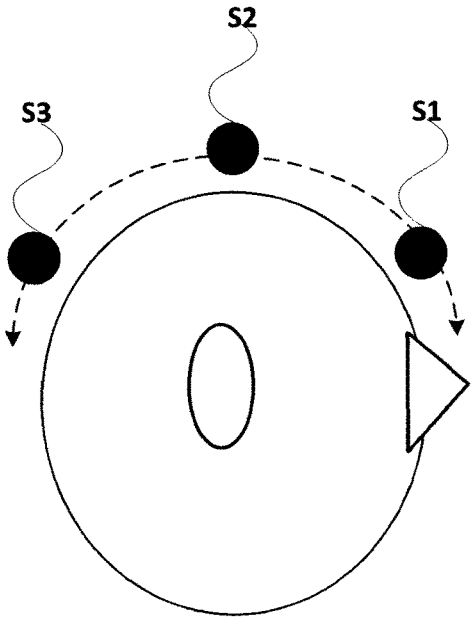

FIG. 2A and FIG. 2B illustrates an example of the position of a sound source which is difficult for the user to recognize through the binaural-rendered audio signal alone. In detail, FIG. 2A illustrates the position of a sound source which is difficult to recognize through the binaural-rendered audio signal alone, as seen from above the head of the user. Furthermore, FIG. 2B illustrates the position of a sound source which is difficult to recognize through the binaural-rendered audio signal alone, as seen beside the head of the user.

A human being may recognize the position of a sound source through the ILD and the ITD of a sound delivered to two ears. Regarding such a spatial cue, people may have different characteristics, and, in particular, in many cases, it is difficult to discriminate front and back or discriminate elevation by means of such a cue. In the case where the interaural level difference and the interaural time difference of the audio signal output from the binaural audio signal processing device 10 are small, for example, in the case where a sound source is distributed around a center of the head of the user, it is difficult for the user of the binaural audio signal processing device 10 to detect the position of the sound source. In detail, it is difficult for the user of the binaural audio signal processing device 10 to recognize whether a sound source is in the front or the back of the user, the sound source being present in the middle between two ears and on a plane which is located at the center of the head and is vertical to a horizontal plane. For example, it is difficult for the user to recognize whether sounds delivered from a first sound source S1, a second sound source S2, and a third sound source S3 of the embodiment of FIGS. 2A and 2B are delivered from the front or the back.

However, when the user listens to a sound from an actual sound source, the user may accurately recognize the position of the sound source by turning the user's head. Furthermore, when the user listens to the sound from the actual sound source, even though position recognition based on the interaural level difference and the interaural time difference is difficult, the user may recognize the position of the sound source through signals which are waves generated due to the sound and delivered to the eardrums via a body portion such as a face. Therefore, if the binaural audio signal processing device 10 generates and gives an additional stimulation to the body of the user, the binaural audio signal processing device 10 may improve three-dimensionality recognized by the user through the binaural-rendered audio signal.

Specific operation of the extra exciter 400 will be described with reference to FIGS. 3 to 6.

Figure 3:
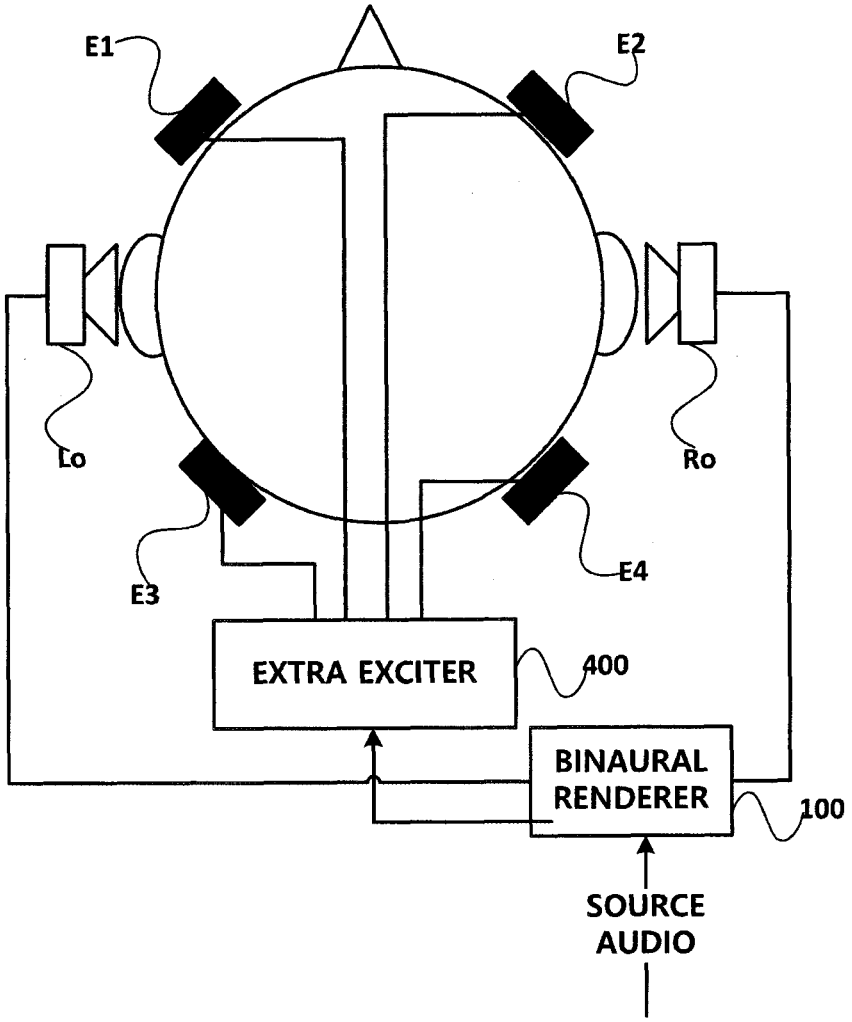
FIG. 3 illustrates an extra exciter included in a binaural audio signal processing device according to an embodiment of the present invention.

FIG. 3 illustrates an extra exciter included in a binaural audio signal processing device according to an embodiment of the present invention.

The extra exciter 400 generates the stimulation to the body of the user based on the binaural-rendered audio signal. In detail, the extra exciter 400 may generate the stimulation to the body of the user synchronized with the binaural-rendered audio signal. In a specific embodiment, the extra exciter 400 may generate the stimulation corresponding to the binaural-rendered audio signal at the same time at which the binaural-rendered audio signal is delivered. In another specific embodiment, the extra exciter 400 may generate the stimulation corresponding to the binaural-rendered audio signal a certain time earlier than the time at which the binaural-rendered audio signal is output. In another specific embodiment, the extra exciter 400 may generate the stimulation corresponding to the binaural-rendered audio signal a certain time later than the time at which the binaural-rendered audio signal is output. In such embodiments, the binaural audio signal processing device 10 may adjust an output time of the binaural-rendered audio signal based on a time taken for the extra exciter 400 to generate the stimulation. For example, the extra exciter 400 may require at least a certain time to generate the stimulation. In this case, three-dimensionality sensed by the user is reduced if the binaural-rendered audio signal is output too early before the stimulation to the body of the user is generated. Therefore, the binaural audio signal processing device 10 may delay a time at which the binaural-rendered audio signal is output. In this manner, the binaural audio signal processing device 10 may constantly maintain a difference between the time at which the stimulation to the body of the user is generated and the time at which the binaural-rendered audio signal is output. Furthermore, in a specific embodiment, in the case where the binaural-rendered audio signal is output together with a video signal, the binaural audio signal processing device 10 may delay output of the audio signal and the video signal.

Furthermore, the extra exciter 400 may generate the stimulation to the body of the user based on the magnitude of the binaural-rendered audio signal. In detail, the larger the magnitude of the binaural-rendered audio signal, the stronger stimulation to the body of the user the extra exciter 400 may generate. For example, in the case where the magnitude of a first audio signal is larger than that of a second audio signal, the extra exciter 400 may generate a stronger stimulation based on the first audio signal than that generated based on the second audio signal. Furthermore, the extra exciter 400 may increase a magnitude of the stimulation to the body of the user in proportion to the magnitude of the binaural-rendered audio signal.

Furthermore, the extra exciter 400 may generate the stimulation to the body of the user based on a distance between the sound source simulated by the binaural-rendered audio signal and the user. In detail, the shorter the distance between the sound source simulated by the binaural-rendered audio signal and the user, the stronger stimulation to the body of the user the extra exciter 400 may generate. For example, in the case where a sound source simulated by a first audio signal is closer to the user than a sound source simulated by a second audio signal, the extra exciter 400 may generate a stronger stimulation based on the first audio signal than that generated based on the second audio signal. In a specific embodiment, the extra exciter 400 may determine the magnitude of the stimulation to the body of the user in inverse proportion to the distance between the sound source simulated by the binaural-rendered audio signal and the user. Furthermore, the extra exciter 400 may generate the stimulation to the body of the user based on depth information of a 3D video signal synchronized with the binaural audio signal.

Furthermore, the extra exciter 400 may generate the stimulation to the body of the user when it is difficult for the user to recognize the position of the sound source simulated by the binaural-rendered audio signal. In detail, the extra exciter 400 may generate the stimulation to the body of the user in at least one of the case where the interaural level difference of the binaural-rendered audio signal is smaller than a first reference value and the case where the interaural time difference is smaller than a second reference value. Here, the first reference value and the second reference value may be different from each other. In detail, in at least one of the case where the interaural level difference of the binaural-rendered audio signal of a specific time point is smaller than the first reference value and the case where the interaural time difference of the binaural-rendered audio signal of a specific time point is smaller than the second reference value, the extra exciter 400 may generate the stimulation to the body of the user during a time period including the time point. Here, a duration of the time period including the time point may be predetermined. In another specific embodiment, the duration of the time period including the time point may be changed according to at least one of the magnitude and the frequency of the binaural-rendered audio signal.

Furthermore, the extra exciter 400 may generate an additional stimulation based on a frequency value of a notch included in a head related transfer function (HRTF) applied to binaural rendering. In detail, the extra exciter 400 may determine whether to generate the additional stimulation based on the frequency value of the notch included in the HRTF. Furthermore, the extra exciter 400 may determine a position at which the additional stimulation is to be generated, based on the frequency value of the notch included in the HRTF. In detail, it may be difficult for the user to recognize, by means of the binaural-rendered audio signal alone, the elevation of the sound source simulated by the binaural-rendered audio signal. However, since human ears are horizontally positioned in parallel with the horizontal plane, the user may recognize the elevation of the sound source through the notch frequency of the HRTF according to an earflap shape. Therefore, the extra exciter 400 may generate the additional stimulation based on the frequency value of the notch included in the HRTF, and the user may recognize, through the generated additional stimulation, the elevation of the sound source simulated by the binaural-rendered audio signal.

Here, the HRTF is a transfer function obtained by modeling a process in which a sound is transferred from a sound source positioned at a specific location to two ears of a human being. In detail, the HRTF may include a binaural room transfer function (BRTF) which is a transfer function obtained by modeling a process in which a sound is transferred from a sound source to two ears of the user while the user and the sound source are positioned indoors. In a specific embodiment, the HRTF may be measured in an anechoic room. Furthermore, the HRTF may be estimated by simulation. A simulation technique used for estimating the HRTF may be at least one of a spherical head model (SHM), a snow man model, a finite-difference time-domain method (FDTDM), and a boundary element method (BEM). Here, the spherical head model may represent a simulation technique in which simulation is performed on the assumption that a human head is spherical. The snow man model may represent a simulation technique in which simulation is performed on the assumption that a human head and torso are spherical.

Furthermore, the extra exciter 400 may generate the stimulation to the body of the user based on a frequency characteristic of the binaural-rendered audio signal. In detail, the extra exciter 400 may increase a frequency of the stimulation to the body of the user in proportion to the frequency of the binaural-rendered audio signal. Furthermore, the higher the frequency of the binaural-rendered audio signal, the stronger stimulation to the body of the user the extra exciter 400 may generate.

The extra exciter 400 may generate the stimulation to the body of the user based on the position of the sound source simulated by the binaural-rendered audio signal. In detail, the extra exciter 400 may include a plurality of excitation transducers, and may select at least one of the plurality of excitation transducers based on the position of the sound source simulated by the binaural-rendered audio signal. The extra exciter 400 may generate the stimulation to the body of the user through the at least one selected excitation transducer. In a specific embodiment, the extra exciter 400 may select at least one of the plurality of excitation transducers according to a distance between the position of the sound source simulated by the binaural-rendered audio signal and each of the plurality of excitation transducers. For example, the extra exciter 400 may include a first excitation transducer for generating a stimulation to a front of the user and a second excitation transducer for generating a stimulation to a back of the user. Here, when the binaural renderer 100 simulates a sound transferred from a sound source located at the front of the user, the extra exciter 400 may generate the stimulation to the body of the user through the first excitation transducer. Furthermore, when the binaural renderer 100 simulates a sound transferred from a sound source located at the back of the user, the extra exciter 400 may generate the stimulation to the body of the user through the second excitation transducer.

As described above, the extra exciter 400 may include the plurality of excitation transducers. In detail, as shown in FIG. 3, the extra exciter 400 may include a first excitation transducer E1, a second excitation transducer E2, a third excitation transducer E3, and a fourth excitation transducer E4.

In the embodiment of FIG. 3, a left side and a right side of the user are differentiated based on a sound output unit Lo for outputting a left side of a stereo sound and a sound output unit Ro for outputting a right side of the stereo sound.

Here, the first excitation transducer E1 may be located at a left front side of the user, and the third excitation transducer E3 may be located at a left back side of the user. Furthermore, the second excitation transducer E2 may be located at a right front side of the user, and the fourth excitation transducer E4 may be located at a right back side of the user. As described above, the extra exciter 400 may generate the stimulation to the body of the user through at least one of the first to fourth excitation transducers E1 to E4 based on the position of the sound source simulated by the binaural-rendered audio signal.

Furthermore, the excitation transducers may be included in a wearable device worn by the user. In detail, the excitation transducers may be included in at least one of goggles, glasses, a helmet, a headphone, an earphone, and a head mount display (HMD).

Furthermore, the magnitude of the stimulation generated by the extra exciter 400 may have a threshold value. The extra exciter 400 may generate the stimulation to the body of the user based on the threshold value. For example, the extra exciter 400 may not generate a stimulation, the magnitude of which is equal to or larger than the threshold value. Furthermore, the extra exciter 400 may determine the threshold value for a stimulation magnitude according to a user input.

Furthermore, the extra exciter 400 may generate the stimulation to the body of the user according to a scaling value applied to a step of discriminating the magnitude of stimulation to the body of the user. The extra exciter 400 may set the scaling value based on a user input. In this manner, even though a stimulation for the binaural-rendered audio signal is generated, the stimulation may be generated with different magnitudes according to users. Furthermore, the extra exciter 400 may set the scaling value for the magnitude of the stimulation generated by the extra exciter 400, based on a user's surrounding environment. Furthermore, the extra exciter 400 may set the scaling value for the magnitude of the stimulation generated by the extra exciter 400, based on an external noise. For example, the extra exciter 400 may set the scaling value for the magnitude of the stimulation generated by the extra exciter 400 higher in a street where a loud noise is made than in a library providing a quiet environment, based on an external noise. To this end, the extra exciter 400 may include a detection device capable of detecting an external environment. In another specific embodiment, the extra exciter 400 may set the scaling value for the magnitude of the stimulation generated by the extra exciter 400, based on the position of the user. For example, the extra exciter 400 may set the scaling value for the magnitude of the stimulation generated by the extra exciter 400 higher when the user is in a home than when the user in a workplace. To this end, the extra exciter 400 may include a detection device for detecting the position of the user.

In detail, when the binaural-rendered audio signal simulates a moving sound source, the extra exciter 400 may generate the stimulation to the body of the user based on movement of the sound source simulated by the binaural-rendered audio signal. This operation will be described in detail with reference to FIG. 4A and FIG. 4B.

Figure 4B:
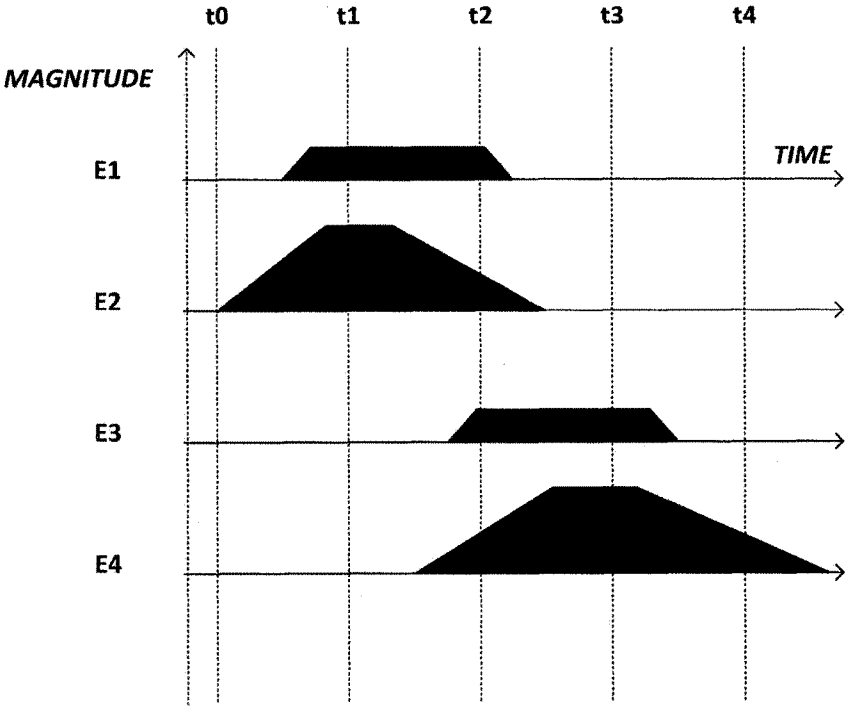
FIGS. 4A and 4B illustrate that an extra exciter according to an embodiment of the present invention generates a stimulation according to movement of a sound source simulated by a binaural audio signal.
Figure 4A:
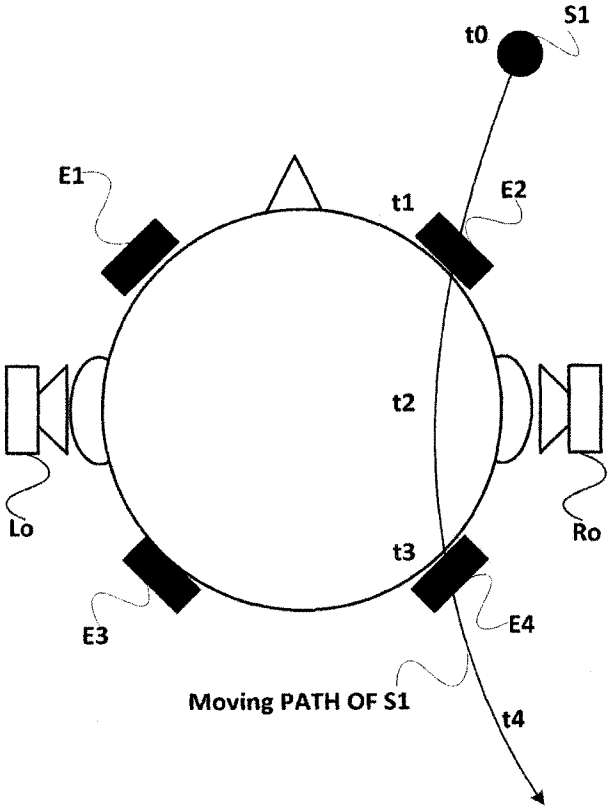

FIG. 4A and FIG. 4B illustrate that an extra exciter according to an embodiment of the present invention generates a stimulation according to movement of a sound source simulated by a binaural audio signal.

As described above, the extra exciter 400 may generate the stimulation to the body of the user based on the movement of the sound source simulated by the binaural-rendered audio signal. In detail, the extra exciter 400 may select at least one of the plurality of excitation transducers included in the extra exciter 400, based on the movement of the sound source simulated by the binaural-rendered audio signal. Here, the extra exciter 400 may generate the stimulation to the body of the user through the selected excitation transducer. In detail, the extra exciter 400 may determine at least one of initiation of stimulation generation of the excitation transducer, end of the stimulation generation, and the magnitude of a generated stimulation, based on the movement of the sound source simulated by the binaural-rendered audio signal.

FIG. 4A illustrates a trajectory representing the movement of the sound source simulated by the binaural-rendered audio signal. FIG. 4B illustrates the magnitudes of the stimulations generated by the first to fourth excitation transducers E1 to E2 with respect to time.

In the embodiment of FIG. 4A and FIG. 4B, the left side and the right side of the user are differentiated based on the sound output unit Lo for outputting a left side of a stereo sound and the sound output unit Ro for outputting a right side of the stereo sound.

The sound source S1 simulated by the binaural-rendered audio signal is initially located at the right front of the user. Thereafter, the sound source simulated by the binaural-rendered audio signal moves to the right back of the user along a parabolic trajectory convex to the center of the head of the user.

In detail, in a first period (t0-t1), the sound source S1 simulated by the binaural-rendered audio signal approaches a right front side of the head of the user. Therefore, the extra exciter 400 gradually generates the stimulation to the body of the user through the second excitation transducer E2 in the first period (t0-t1), and starts to generate a vibration through the first excitation transducer E1 after a middle of the first period (t0-t1).

Furthermore, in a second period (t1-t2), the sound source S1 simulated by the binaural-rendered audio signal passes by the right ear of the user. Therefore, the extra exciter 400 gradually decreases, in the second period (t1-t2), the magnitude of the stimulation generated by the second excitation transducer E2, and generates the stimulation through the third excitation transducer E3 and the fourth excitation transducer E4 after a middle of the second period (t1-t2).

Furthermore, in a third period (t2-t3), the sound source S1 simulated by the binaural-rendered audio signal is located at the right back side of the head of the user. Therefore, the extra exciter 400 stops, in the third period (t2-t3), operation of the first excitation transducer E1 and the second excitation transducer E2, and continues to generate the stimulation through the third excitation transducer E3 and the fourth excitation transducer E4 after a middle of the third period (t2-t3).

Furthermore, in a fourth period (t3-t4), the sound source S1 simulated by the binaural-rendered audio signal moves to the right back of the head of the user and gradually moves away from the user. Therefore, the extra exciter 400 stop, in the fourth period (t3-t4), operation of the third excitation transducer E1, and continuously reduces the magnitude of the stimulation generated by the fourth excitation transducer E3 in the fourth period (t3-t4).

Through this operation, the binaural audio signal processing device 10 may represent the three-dimensionality of a sound transferred from a moving sound source.

The extra exciter 400 has been described as including the excitation transducer in the embodiment of FIGS. 3, 4A and 4B. However, as described above, the excitation transducer may be located outside the extra exciter 400, and the extra exciter 400 may generate a control signal for controlling the excitation transducer located outside the extra exciter. Even in this case, the embodiment of FIGS. 3, 4A and 4B in which the stimulation to the body of the user which corresponds to the binaural audio signal is generated may be equally applied.

When the binaural audio signal processing device 10 generates an additional stimulation while outputting the binaural audio signal, the additional stimulation may affect a sound transferred to the user. For example, in the case of a stimulation through bone conduction, a sound in which a low-frequency component is enhanced may be transferred to the user. Therefore, the binaural audio signal processing device 10 may perform binaural rendering on a received audio signal based on whether to generate the additional stimulation.

Figure 5:
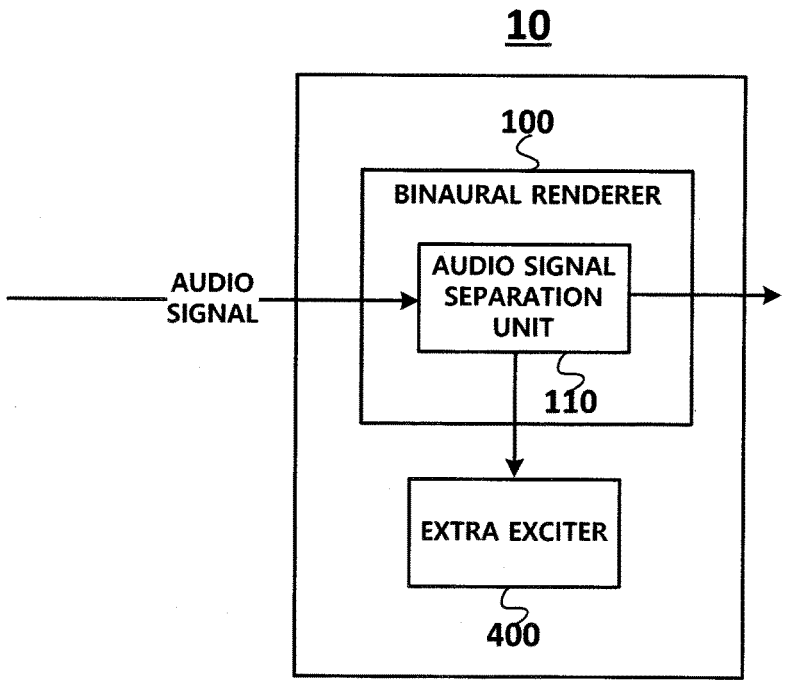
FIG. 5 illustrates a binaural audio signal processing device which separates an audio signal to be output based on whether to generate an additional stimulation according to an embodiment of the present invention.

FIG. 5 illustrates a binaural audio signal processing device which separates an audio signal to be output based on whether to generate an additional stimulation according to an embodiment of the present invention.

The binaural audio signal processing device 10 may separate a received audio signal into a first audio signal to be output through the extra exciter 400 and a second audio signal to be output through the binaural renderer 100. In detail, the binaural audio signal processing device 10 may separate the received audio signal into the first audio signal and the second audio signal according to a frequency characteristic. In a specific embodiment, the first audio signal may be an audio signal of a low-frequency band, and the second audio signal may be an audio signal of a mid-frequency band and a high-frequency band. Here, the audio signal of the low-frequency band may be an audio signal with a frequency lower than first reference value. Furthermore, the audio signal of the mid-frequency band and the high-frequency band may be an audio signal with a frequency higher than a second reference value. In a specific embodiment, the first reference value may be equal to or larger than the second reference value.

To this end, the binaural renderer 100 may generate the first audio signal by performing low-pass filtering on the received audio signal, and may transfer the first audio signal to the extra exciter 400. Furthermore, the binaural renderer 100 may generate the second audio signal by performing high-pass filtering on the received audio signal.

In another specific embodiment, the binaural renderer 100 may apply, to the received audio signal, a head related transfer function (HRTF) for modeling a remaining region excepting an audio signal of a frequency band corresponding to the first audio signal. In detail, the binaural renderer 100 may store an HRTF for modeling only a frequency band corresponding to the second audio signal, and may perform binaural rendering on the second audio signal by applying the stored HRTF. In this case, the binaural renderer 100 may increase efficiency of processing for binaural rendering. For example, the binaural renderer 100 may simultaneously store an HRTF to which a high pass filter for removing a low-frequency band is applied and an HRTF to which a high pass filter is not applied. In this case, instead of filtering the received audio signal through a high pass filter and then applying an HRTF thereto, the HRTF to which a high pass filter is applied may be directly applied to the received audio signal. Therefore, a processing amount may be reduced by as much as processing required for the filtering through a high pass filter.

As described above, the first audio signal is an audio signal output through the extra exciter 400. In detail, the first audio signal may be a signal filtered by a filter having a response characteristic and a frequency band corresponding to a reproduction band of a bone conduction transducer. Here, the second audio signal may be generated based on a signal obtained by subtracting the first audio signal from the audio signal received by the binaural audio signal processing device 10. In detail, the second audio signal may be a signal obtained by subtracting the first audio signal from the audio signal received by the binaural audio signal processing device 10.

The binaural renderer 100 may perform binaural rendering on the second audio signal and may output the binaural-rendered signal. Furthermore, the extra exciter 400 may generate the stimulation to the body of the user based on the first audio signal. Here, the stimulation generated by the extra exciter 400 may be a bone conduction signal.

As described above, the binaural audio signal processing device 10 may perform binaural rendering on a received audio signal based on whether to generate the additional stimulation. Therefore, in the case of generating the additional stimulation, the binaural audio signal processing device 10 may separate the received audio signal into the first audio signal and the second audio signal as described above.

Furthermore, the stimulation generated by the extra exciter 400 may be a stimulation through bone conduction.

In the embodiment of FIG. 5, the binaural renderer 100 includes an audio signal separation unit 110. The audio signal separation unit 100 separates a received audio signal into the first audio signal and the second audio signal. In detail, in the case where the additional stimulation is generated, the audio signal separation unit 110 may separate the received audio signal into the first audio signal and the second audio signal. As described above, in the case where the additional stimulation is generated, the audio signal separation unit 110 may separate the received audio signal into the first audio signal and the second audio signal according to a frequency characteristic. Specific operation of the audio signal separation unit 110 may be in accordance the above-described operation of the binaural renderer 100.

Figure 6:
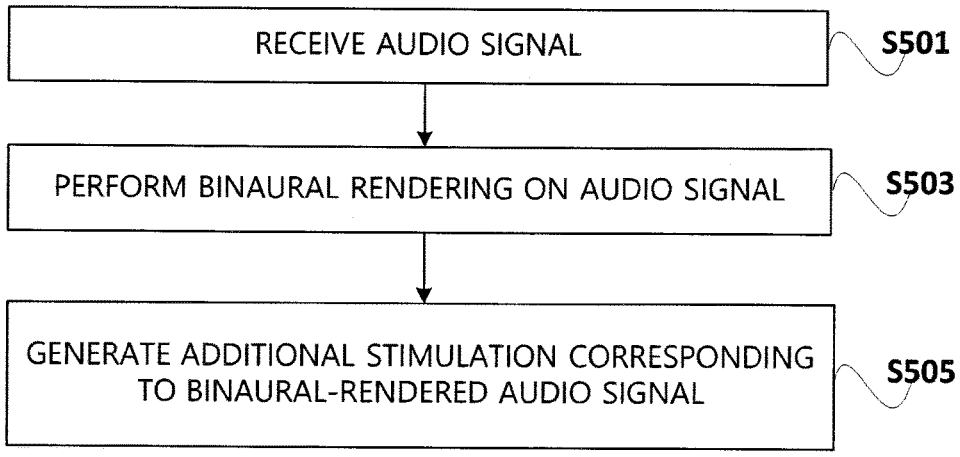
FIG. 6 illustrates operation of a binaural audio signal processing device according to an embodiment of the present invention.

FIG. 6 illustrates operation of a binaural audio signal processing device according to an embodiment of the present invention.

The binaural renderer 100 receives an audio signal (S501). Here, the audio signal received by the binaural renderer 100 may be a mono audio signal or an audio signal including one object. In another embodiment, the audio signal received by the binaural renderer 100 may be an audio signal including a plurality of objects or a plurality of channel signals.

The binaural renderer 100 performs binaural rendering on the audio signal (S503). The binaural renderer 100 may perform binaural rendering on the audio signal through various embodiments. As described above in relation to the embodiment of FIG. 5, the binaural renderer 100 may perform binaural rendering on the received audio signal based on whether to generate an additional stimulation. The audio signal received by the binaural audio signal processing device 10 may include a first audio signal and a second audio signal. Here, the extra exciter 400 may output the first audio signal, and the binaural renderer 100 may output the second audio signal. In detail, the second audio signal may be a signal obtained by subtracting the first audio signal from the audio signal received by the binaural audio signal processing device 10. In detail, as described above in relation to the embodiment of FIG. 5, the signal received by the binaural renderer 100 may be separated into the first audio signal and the second audio signal. The first audio signal and the second audio signal may have specific characteristics as described above.

The extra exciter 400 generates an additional stimulation corresponding to the binaural-rendered audio signal (S505). To this end, the extra exciter 400 may receive the audio signal received by the binaural renderer. In another specific embodiment, the extra exciter 400 may receive the binaural-rendered audio signal. In another specific embodiment, the extra exciter 400 may receive the first audio signal as described above. In this case, the extra exciter 400 may obtain information for generating the stimulation to the body of the user from at least one of the audio signal received by the binaural renderer 100, the binaural-rendered audio signal, and the first audio signal. In detail, the information required for generating the stimulation to the body of the user may be at least one of position information indicating the position of a sound source simulated by the binaural-rendered audio signal, the magnitude of the binaural-rendered audio signal, the frequency of the binaural-rendered audio signal, and synchronization information of the binaural-rendered audio signal. Here, in the case where the audio signal is a channel signal, the position information may be information indicating the position of a sound source formed on a three-dimensional sound scene formed by the channel signal. In the case where the audio signal is an object signal, the position information may be information indicating a position corresponding to the position on a three-dimensional sound scene identified by metadata on an object.

The binaural audio signal processing device 10 may further include a binaural parameter controller. The binaural parameter controller generates a binaural parameter for binaural rendering, and transfers the binaural parameter to the binaural renderer 100. In this case, the binaural parameter controller may transfer, to the extra exciter 400, information required for generating the stimulation to the body of the user. Here, the extra exciter 400 may generate additional stimulation based on the information required for generating the stimulation to the body of the user.

Furthermore, the stimulation generated by the extra exciter 400 may be delivered to the head of the user. In detail, the stimulation generated by the extra exciter 400 may be delivered to the user's eardrums. This is because a human being can more precisely recognize the position of a sound source when sound waves are delivered to the eardrums through the head. To this end, the excitation transducer included in the extra exciter 400 may be located within a certain distance from the head of the user. In detail, the excitation transducer may be located on at least one of the head, the ears, and the neck. Furthermore, the extra exciter 400 may include a plurality of excitation transducers. A location of each of the plurality of excitation transducers may be specified in advance. In another specific embodiment, the extra exciter 400 may measure the location of each of the plurality of excitation transducers, and may generate a stimulation according to the measured location of each of the plurality of excitation transducers. In detail, the extra exciter 400 may determine at least one of the magnitude of the stimulation, a time at which the stimulation is generated, and a duration of the stimulation.

In detail, the extra exciter 400 may generate the stimulation synchronized with the binaural-rendered audio signal to provide the stimulation to the body of the user. In detail, the stimulation may include at least one of a non-invasive brain/neural excitation, a vibration, and a bone conduction signal. In detail, the non-invasive brain/neural excitation may be any one of a transcranial direct current stimulation, a transcranial alternating current stimulation, a transcranial magnetic stimulation, and a transcranial electrical stimulation.

Furthermore, the extra exciter 400 may generate the stimulation synchronized with the binaural-rendered audio signal to provide the stimulation to the body of the user. In a specific embodiment, the extra exciter 400 may generate the stimulation corresponding to the binaural-rendered audio signal at the same time at which the binaural-rendered audio signal is output. In another specific embodiment, the extra exciter 400 may generate the stimulation corresponding to the binaural-rendered audio signal a certain time earlier than the time at which the binaural-rendered audio signal is output. In another specific embodiment, the extra exciter 400 may generate the stimulation corresponding to the binaural-rendered audio signal a certain time later than the time at which the binaural-rendered audio signal is output. In such embodiments, the binaural audio signal processing device 10 may adjust an output time of the binaural-rendered audio signal based on a time taken for the extra exciter 400 to generate the stimulation. Specific operation of the binaural audio signal processing device 10 may be the same as the above-described embodiments.

Furthermore, the extra exciter 400 may generate the stimulation to the body of the user based on the magnitude of the binaural-rendered audio signal.

Furthermore, the extra exciter 400 may generate the stimulation to the body of the user based on the distance between the sound source simulated by the binaural-rendered audio signal and the user.

Furthermore, the extra exciter 400 may generate the stimulation to the body of the user when it is difficult for the user to recognize the position of the sound source simulated by the binaural-rendered audio signal. In detail, the extra exciter 400 may generate the stimulation to the body of the user in at least one of the case where the interaural level difference of the binaural-rendered audio signal is smaller than a first reference value and the case where the interaural time difference of the binaural-rendered audio signal is smaller than a second reference value. Here, specific operation of the extra exciter 400 may be the same as the above-described embodiment.

Furthermore, the extra exciter 400 may generate the stimulation to the body of the user based on the frequency characteristic of the binaural-rendered audio signal.

The extra exciter 400 may generate the stimulation to the body of the user based on the position of the sound source simulated by the binaural-rendered audio signal. In detail, the extra exciter 400 may include the plurality of excitation transducers, and may select at least one of the plurality of excitation transducers based on the position of the sound source simulated by the binaural-rendered audio signal to generate the stimulation. Here, the extra exciter 400 may be synchronized with a time of a simulated signal of the binaural-rendered audio signal.

Furthermore, the extra exciter 400 may adjust the magnitude of the stimulation to the body of the user based on a threshold value. In detail, the extra exciter 400 may not generate a stimulation, the magnitude of which is equal to or larger than the threshold value. In a specific embodiment, the extra exciter 400 may determine the threshold value for the magnitude of stimulation according to a user input.

Furthermore, the extra exciter 400 may generate the stimulation to the body of the user according to a scaling value applied to a step of discriminating the magnitude of stimulation to the body of the user. The extra exciter 400 may set the scaling value based on a user input.

Furthermore, the extra exciter 400 may generate the stimulation to the body of the user when it is difficult for the user to recognize the position of the sound source simulated by the binaural-rendered audio signal. In detail, the extra exciter 400 may generate the stimulation to the body of the user in at least one of the case where the interaural level difference of the binaural-rendered audio signal is smaller than a first reference value and the case where the interaural time difference is smaller than a second reference value. Here, the first reference value and the second reference value may be different from each other. In detail, in at least one of the case where the interaural level difference of the binaural-rendered audio signal of a specific time point is smaller than the first reference value and the case where the interaural time difference of the binaural-rendered audio signal of a specific time point is smaller than the second reference value, the extra exciter 400 may generate the stimulation to the body of the user during a time period including the time point. Here, a duration of the time period including the time point may be predetermined. In another specific embodiment, the duration of the time period including the time point may be changed according to at least one of the magnitude of the binaural-rendered audio signal and the frequency of the binaural-rendered audio signal. In another specific embodiment, the extra exciter 400 may generate an additional stimulation based on a frequency value of a notch included in an HRTF applied to binaural rendering. In detail, the extra exciter 400 may determine whether to generate the additional stimulation based on the frequency value of the notch included in the HRTF. Furthermore, the extra exciter 400 may determine a position at which the additional stimulation is to be generated, based on the frequency value of the notch included in the HRTF. In detail, it may be difficult for the user to recognize, by means of the binaural-rendered audio signal alone, the elevation of the sound source simulated by the binaural-rendered audio signal. However, since human ears are horizontally positioned in parallel with the horizontal plane, the user may recognize the elevation of the sound source through the notch frequency of the HRTF according to an earflap shape. Therefore, the extra exciter 400 may generate the additional stimulation based on the frequency value of the notch included in the HRTF, and the user may recognize, through the generated additional stimulation, the elevation of the sound source simulated by the binaural-rendered audio signal.

As described above, the excitation transducer may be located outside the extra exciter 400, and the extra exciter 400 may generate a control signal for controlling the excitation transducer located outside the extra exciter. Even in this case, the embodiment described above with reference to FIG. 6 may be equally applied to the binaural audio signal processing device 10.

The binaural audio signal processing device 10 according to an embodiment of the present invention may be used in various sound output devices and various electronic devices realizing virtual reality (VR) or augmented reality (AR). In particular, the binaural audio signal processing device 10 according to an embodiment of the present invention may be used in wearable electronic devices such as an HMD, glasses, a helmet, etc.

Although the present invention has been described using the specific embodiments, those skilled in the art could make changes and modifications without departing from the spirit and the scope of the present invention. That is, although the embodiments of binaural rendering for multi-audio signals have been described, the present invention can be equally applied and extended to various multimedia signals including not only audio signals but also video signals. Therefore, any derivatives that could be easily inferred by those skilled in the art from the detailed description and the embodiments of the present invention should be construed as falling within the scope of right of the present invention.

The invention claimed is:

1. An audio signal processing device comprising:

a binaural renderer configured to receive an audio signal and output a binaural-rendered audio signal by performing binaural rendering based on the received audio signal; and an extra exciter comprising a first excitation transducer placed in front of a user and a second excitation transducer placed at the back of the user, wherein the first and second transducers generate different stimulations in response to a position of a sound source simulated by the binaural-rendered audio signal, wherein the extra exciter is configured to select at least one of the first and second excitation transducers according to the position of the sound source and to generate a stimulation through the selected excitation transducer only, wherein the stimulation corresponds to the binaural-rendered audio signal.

2. The audio signal processing device of claim 1, wherein the extra exciter is configured to generate the stimulations to a head of the user.

3. The audio signal processing device of claim 1, wherein the extra exciter generates the stimulation based on a distance between the user and the position of the sound source simulated by the binaural-rendered audio signal.

4. The audio signal processing device of claim 1, wherein the extra exciter generates the stimulation in at least one of a case where an interaural level difference of the binaural-rendered audio signal is smaller than a first reference value and a case where an interaural time difference of the binaural-rendered audio signal is smaller than a second reference value.

5. The audio signal processing device of claim 1, wherein the extra exciter generates an additional stimulation based on a frequency value of a notch included in a head related transfer function (HRTF) applied to the binaural rendering.

6. The audio signal processing device of claim 5, wherein the extra exciter determines whether to generate the additional stimulation based on the frequency value of the notch included in the HRTF.

7. The audio signal processing device of claim 5, wherein the extra exciter determines a position at which the additional stimulation is to be generated, based on the frequency value of the notch included in the HRTF.

8. The audio signal processing device of claim 1, wherein the received audio signal comprises a first audio signal output through the extra exciter and a second audio signal output through the binaural renderer, wherein the second audio signal is generated based on an audio signal obtained by subtracting the first audio signal from the received audio signal.

9. The audio signal processing device of claim 8, wherein the binaural renderer separates the received audio signal into the first audio signal and the second audio signal according to a frequency characteristic of the received audio signal.

10. The audio signal processing device of claim 8, wherein the binaural renderer applies, to the received audio signal, a head related transfer function (HRTF) for modeling a remaining region excepting a frequency band corresponding to the first audio signal.

11. The audio signal processing device of claim 1, wherein the stimulation is synchronized with a time of the binaural-rendered audio signal.

12. The audio signal processing device of claim 1, wherein the extra exciter generates the stimulation based on a magnitude of the binaural-rendered audio signal.

13. The audio signal processing device of claim 1, wherein the extra exciter generates the stimulation according to a scaling value applied to a step of discriminating a magnitude of the stimulation, wherein the scaling value is determined based on a noise of an external environment of the user.

14. A method for operating an audio signal processing device, the method comprising the steps of:

receiving, by a binaural renderer, an audio signal;

outputting, by the binaural renderer, a binaural-rendered audio signal by performing binaural rendering based on the received audio signal; and selecting, by an extra exciter, at least one of a first excitation transducer placed in front of a user and a second excitation transducer placed at the back of the user, and generating a stimulation through the selected excitation transducer only, wherein the stimulation corresponds to the binaural-rendered audio signal, wherein the first and second transducers generate different stimulations in response to a position of a sound source simulated by the binaural-rendered audio signal.

* * * * *